US007453215B2

(12) United States Patent
Zhu

(10) Patent No.: US 7,453,215 B2
(45) Date of Patent: Nov. 18, 2008

(54) ILLUMINATION SYSTEM HAVING COLD CATHODE STARTED, ILLUMINATION CONTROLLED GAS DISCHARGE LAMPS IN SERIES

(76) Inventor: Furu Zhu, Room No. 103, House No. 64, Zhong Nan Xin Cun, Zhongqiao, Wuxi, Jiangsu (CN) 214073

( * ) Notice: Subject to any disclaimer, the term of this patent is extended or adjusted under 35 U.S.C. 154(b) by 315 days.

(21) Appl. No.: 11/259,752

(22) Filed: Oct. 26, 2005

(65) Prior Publication Data

US 2006/0164022 A1 Jul. 27, 2006

Related U.S. Application Data

(63) Continuation of application No. PCT/CN2004/000404, filed on Apr. 26, 2004.

(30) Foreign Application Priority Data

Apr. 27, 2003 (CN) ..... 03123028.8

(51) Int. Cl.
*H05B 37/00* (2006.01)

(52) U.S. Cl. ..... 315/201; 315/205

(58) Field of Classification Search ..... 315/149, 315/185 R, 186, 189, 200 R, 201, 205, 206, 315/209 R, 210, 212, 291, 307, 308
See application file for complete search history.

(56) References Cited

U.S. PATENT DOCUMENTS 6,339,298 B1 * 1/2002 Chen ..... 315/224
6,459,213 B1 * 10/2002 Nilssen ..... 315/224
6,674,249 B1 * 1/2004 Leskovec ..... 315/289

FOREIGN PATENT DOCUMENTS

CN 2089685 U 11/1991
JP 6283285 A 10/1994

* cited by examiner

*Primary Examiner*—Thuy Vinh Tran
(74) *Attorney, Agent, or Firm*—Dorsey & Whitney LLP

(57) ABSTRACT

An illumination system having cold cathode started, illumination controlled gas discharge lamps in series, includes the parts of a voltage-adjustable full-wave voltage-doubler rectifier power supply, a gas discharge lamp operating serially with the full-wave rectifier power supply, and inductor-resistor switches for controlling illumination. The system includes a plurality of tubes operated serially with cold cathode starter; the positive and negative half periods of a half-wave voltage-doubler rectifier power supply combined by isolating diodes to form a full-wave voltage-doubler rectifier power supply; a main power supply of the illumination system formed by combining a power supply of full-wave rectified having low voltage and large current with a power supply of full-wave voltage-doubler having high voltage through utilization of potential switched diodes; and a main power supply having high voltage with large internal resistance and low voltage with large current formed by the full-wave voltage-doubler power supply together with the full-wave rectifier power supply for supplying the power to the gas discharge lamp having a plurality of tubes connected in series via the serial inductor and illumination control switch, thus, constituting an illumination system having cold cathode started gas discharge lamps in series with illumination controlled.

11 Claims, 3 Drawing Sheets

ILLUMINATION SYSTEM HAVING COLD CATHODE STARTED, ILLUMINATION CONTROLLED GAS DISCHARGE LAMPS IN SERIES

CROSS-REFERENCE TO RELATED APPLICATION(S)

This application is a continuation of International application number PCT/CN2004/000404 filed Apr. 26, 2004 which claims priority to Chinese application No. CN 03123028.8 filed Apr. 27, 2003, the contents of both are herein incorporated in their entirety by reference.

TECHNICAL FIELD

The invention relates to a physical, electro-optical source device, particularly, it relates to an illumination system having cold cathode started illumination controlled gas discharge lamps in series.

BACKGROUND ART

The prior gas discharge lamps, such as the fluorescent lamp, high voltage mercury lamp, and the like, are powered by inductive ballasts, neon bimetal sheet startors or electronic ballasts with inverter power supply, because these gas discharge lamps use warm cathode start, so they have some disadvantages, for example, the failures of the tubes may occur easily, such as the filament being broken due to burning, the voltage of the startor being high, and the operation voltage after starting being high, and the like, even not illuminating or starting normally. While processing the wasted fluorescent lamp tubes, it further causes the environment being polluted by the mercury.

SUMMARY OF THE INVENTION

The object of the invention is to provide an electro-optical source illumination system having a plurality of sets of cold cathode started tubes with illumination controlled and driven by a set of power supplies, said electro-optical source illumination system has the effects of energy saving, long used life, low cost, safe and reliable, and the tubes being used sufficiently, and the pollution of the environment from the mercury being reduced.

The object of the invention is implemented in such a manner that: an illumination system having cold cathode started, illumination controlled gas discharge lamps in series comprises the parts of a voltage adjustable full-wave voltage-doubler rectifier power supply, a gas discharge lamp operating serially with the full-wave rectifier power supply, an inductor-resistor switches for controlling illumination, and the like, is characterized in that:

1) a plurality of tubes operates serially with cold cathode started;

2) the positive and negative half periods of a half-wave voltage-doubler rectifier power supply are combined by the isolating diodes ($D_{3A}$, $D_{3B}$, $D_{3C}$, and $D_{3D}$) to form a full-wave voltage-doubler rectifier power supply;

3) a main power supply of the said illumination system is formed by combining a power supply of full-wave rectified having low voltage and large current with a power supply of full-wave voltage-doubler having high voltage through the utilization of the potential switched diodes ($D_M'$, $D_N'$); and 4) a main power supply having high voltage with large internal resistance and low voltage with large current is formed by the full-wave voltage-doubler power supply together with the full-wave rectifier power supply for supplying the power to the gas discharge lamp having a plurality of tubes connected in series via the serial inductor (L) and illumination control switch (K), thus, constituting an illumination system having cold cathode started gas discharge lamps in series with illumination controlled.

In the above illumination system, wherein the said illumination system, which can be cold cathode started in series with illumination controlled, is composed of a plurality of tubes connected in series.

In the above illumination system, wherein the said tube in series is a cold cathode fluorescent lamp tube having single output lead and cover like electrode.

In the above illumination system, wherein two ends of the tube in series are connected with a switch in parallel.

In the above illumination system, wherein an alternating current path in the said full-wave voltage-doubler power supply is formed by the connecting point ($E_+$, $F_+$, $E_-$, or $F_-$) of the voltage-doubler capacitors of the first stage and the access resistor or inductor, or the bi-directional thyristor, or the full-wave rectifier current amplifier.

In the above illumination system, wherein the power is supplied to the tubes by a main power supply combined by a full-wave rectifier power supply having low voltage with large current and a full-wave voltage-doubler high voltage power supply via the potential switched diodes ($D_M'$, $D_N'$) in the said full-wave rectifier power supply.

In the above illumination system, wherein the said main power supply is composed of a full-wave rectification filter capacitor ($C_3'$), which is adjustable at steps, and a resistor ($R_C'$) or a diode connected in series with the capacitor for eliminating the sparks.

In the above illumination system, wherein the full-wave voltage-doubler power supply further comprises a non-polarity large capacitor composed of tandem pairs of an electrolytic capacitor and a diode connected in parallel.

In the above illumination system, wherein the said cold cathode started in series and illumination controlled illumination system further comprises a high voltage full-wave voltage-doubler rectifier power supply controlled by a delay circuit or the lamp current passing through an AC switch, the power supply is cut off after the gas discharge lamp being lighting up, and then the power is supplied by a full-wave rectifier power supply of low voltage with large current or a voltage-doubler power supply.

Because the invention employs a plurality of sets of tubes driven by a set of power supplies which are high voltage with large internal resistance, low voltage with large current, voltage adjustable, reliable, and illumination controlled, and the voltage drop of the tube itself being used as a power supply for other tubes, so it can achieve the object of saving the energy source, and further lead to a result of reducing the cost.

BRIEF DESCRIPTION OF THE DRAWINGS

The performances and the features of the invention will be further described below in conjunction with the Drawings and the embodiments, wherein.

DETAILED DESCRIPTION

The following five topics describe the preferred embodiments of the invention, respectively.

Figure 1:
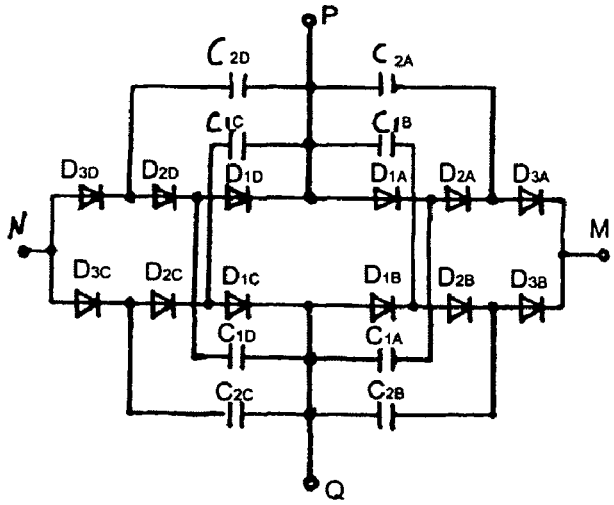
FIG. 1 is a circuit diagram in accordance with the invention illustrating a full-wave rectifier power supply having large power, high voltage, and large internal resistance.

I. Full-Wave Voltage-Doubler Rectifier Power Supply Having Large Power And High Voltage With Large Internal Resistance The circuit diagram of the power supply is shown in FIG. 1. In FIG. 1, the P and Q are the input terminals for AC commercial power, M and N are the output terminals of the high voltage direct current, D is a rectifier diode, and C is a voltage-doubler capacitor.

In FIG. 1, a positive power supply of two stages of the positive half-wave voltage-doubler rectifier is composed of voltage-doubler rectifier diode $D_{1A}$, with capacitor $C_{1A}$ and $D_{2A}$ with $C_{2A}$. And a positive power supply of two stages of negative half-wave voltage-doubler rectifier is composed of $D_{1B}$ with $C_{1B}$ and $D_{2B}$ with $C_{2B}$. The outputted positive supplies are converged by the isolating diodes $D_{3A}$ and $D_{3B}$ at point M and outputted, thus, a positive power supply having a full-wave voltage-doubler output is formed.

The number of the voltage-doubler stages can be increased or decreased to satisfy the required voltage levels of the power supply as required.

When it starts to operate, the voltage on the voltage-doubler capacitor is zero, and it is supposed that the circuit is turned on at the time when the municipal power of the alternating current passes zero.

1) In the Positive Half Period, P is Positive, and Q is Negative.

The voltage-doubler capacitor $C_{1A}$ is charged by the municipal power of the alternating current at point P via the voltage-doubler rectifier diode $D_{1A}$ so that the $V_{C1A}$ is charged to the peak voltage $V_{PQ}$ and then held.

2) In the negative half period, P is negative, and Q is positive.

Similarly, the voltage-doubler capacitor $C_{1B}$ is charged by the municipal power of the alternating current at point Q via the voltage-doubler rectifier diode $D_{1B}$ so that $V_{C1B}$ is charged to a peak voltage $V_{QP}$ and then held.

At this point, $C_{1A}$ is also discharged to the voltage-doubler capacitor $C_{2A}$ via voltage-doubler rectifier diode $D_{2A}$, and $C_{2A}$ is charged to a peak voltage $(V_{QP}+V_{PQ})[C_{1A}/(C_{1A}+C_{2A})]$.

3) Similarly, in the positive half period of the second period, $C_{1A}$ is charged positively via $D_{1A}$, $C_{1B}$ is discharged to $C_{2B}$ via $D_{2B}$, and $C_{2B}$ is charged to $2VC_{1B}/(C_{1B}+C_{2B})$ (because $V_{PQ}=V_{QP}$, so they are expressed uniformly by V).

At this point, because the voltage at point P is positive, it allows $C_{2B}$ to discharge to point M via $D_{3A}$, the discharging voltage is $V[1+2C_{1A}/(C_{1A}+C_{2A})]$. If $C_{2A}<<C_{1A}$, then $V_{MQ}=3V$. M outputs a voltage that is three times of that in the positive half period.

4) Similarly, in the negative half period of the second period, $C_{1B}$ is charged positively via $D_{1B}$, $C_{1A}$ is discharged to $C_{2A}$ via $D_{2A}$, and $C_{2A}$ is charged.

At this point, because the voltage at point Q is positive, it allows $C_{2B}$ to discharge to point M via $D_{3B}$, the discharging voltage is $V[1+2C_{1B}/(C_{1B}+C_{2B})]$. If $C_{2B}<<C_{1B}$ , then $V_{MP}=3V$. M outputs a voltage that is three times of that in the negative half period.

Similarly, the above results appear on $D_{1C}$, $C_{1C}$, $D_{2C}$, $C_{2C}$, and $D_{1D}$, $C_{1D}$, $D_{2D}$, $C_{2D}$, and $D_{3C}$, $D_{3D}$, only differing in that the voltage outputted from point N is a voltage that is three times of that in the negative period of the full-wave.

If power is supplied from the M and N to the external, then $V_M-V_N=V_{MN}=5V$ ($V_{PQ}$, $V_{QP}$ are canceled each other).

Therefore, the high voltage power supply composed of only the voltage-doubler rectifier diodes and the voltage-doubler capacitors can combine two sets of half-wave voltage-doubler power supply into a full-wave voltage-doubler power supply for outputting.

A high voltage direct current power supply can be obtained by selecting properly the sizes of the diodes and the voltage-doubler capacitors.

II. Voltage Adjustable Full-Wave Voltage-Doubler Rectifier Power Supply

Figure 2A:
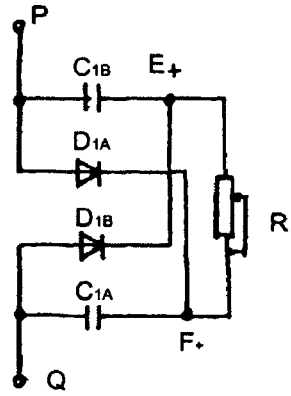
FIG. 2(A) is a circuit diagram of a voltage-adjustable full-wave voltage-doubler rectifier power supply controlled by resistor in accordance with the invention.

If a discharge path is provided between points $E_+$ and $F_+$ of the voltage-doubler capacitors $C_{1A}$ and $C_{1B}$, that is, points $E_+$, $F_+$ are connected by a resistor or an inductor to make $C_{1A}$ and $C_{1B}$ to charge and discharge with each other in the positive and negative half periods, then the output voltage at point M can be adjusted, as shown in FIGS. 2(A), (B), (C), and (D).

As shown in FIG. 2(A), a resistor R is connected between points $E_+$ and $F_+$ to provide a path for $C_{1A}$ and $C_{1B}$ to charge and discharge with each other in the positive and negative half periods. If R=0, then it will be simplified as a positive voltage output arm of a full-wave rectifier bridge formed by connecting $D_{1A}$ and $D_{1B}$ to $C_{1B}$ and $C_{1A}$ in parallel respectively, and the voltage-doubler function will be lost.

If $R=\infty$, then it will be a full-wave voltage-doubler rectifier circuit as described above.

In this manner, $V_{E+F+}$ can be adjusted continuously between $0\sim V_{PQ}$ by adjusting R.

Figure 2B:
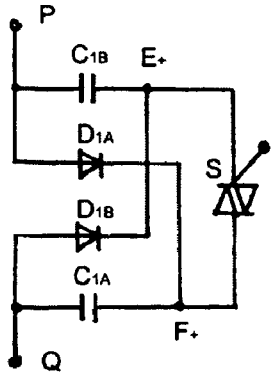
FIG. 2(B) is a circuit diagram of a voltage-adjustable full-wave voltage-doubler rectifier power supply controlled by bidirectional thyristor in accordance with the invention.
Figure 2C:
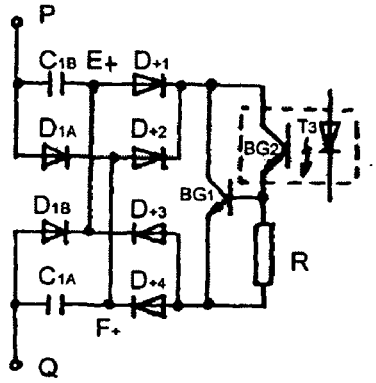
FIG. 2(C) is a circuit diagram of a voltage-adjustable full-wave voltage-doubler rectifier power supply controlled by photocoupler and full-wave rectifier current amplifier in accordance with the invention.

The said resistor can be formed by bi-directional thyristor S or full-wave rectifier current amplifier ($D_{+1}$, $D_{+2}$, $D_{+3}$, $D_{+4}$, $BG_{+1}$, $BG_{+2}$, $T_+$, $R_+$), as shown in FIGS. 2(B), (C). A photocoupler is shown in the dotted box of FIG. 2(C).

Figure 2D:
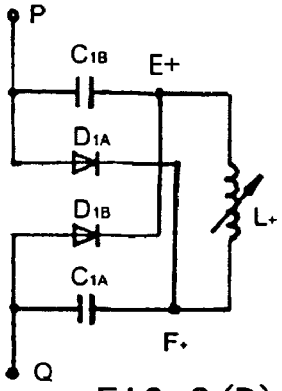
FIG. 2(D) is a circuit diagram of a voltage-adjustable full-wave voltage-doubler rectifier power supply controlled by magnetic saturation reactor and inductor in accordance with the invention.

In FIG. 2(D), an inductor $L_+$ is connected between points $E_+$ and $F_+$, at this point, a serial loop is formed by $C_{1A}$, $C_{1B}$, and $L_+$, the output voltage can be adjusted by changing the magnitude of $L_+$.

When the serial connection of $L_+$ and $(C_{1A}+C_{1B})/2$ is resonated with the power supply, $V_{E+F+}=QV_{PQ}$, (Q is the quality factor of the series resonance loop), it can further boost the output voltage of the power supply to achieve the result of boosting the alternating voltage. Thus, the output voltage of the loop can be adjusted by adjusting the magnitude of $L_+$. If a magnetic saturation reactor is used to control in the primary DC winding, then a satisfactory function of adjusting continuously can be obtained.

III. Full-Wave Rectifier Power Supply Having Potential Switches

Figure 3:
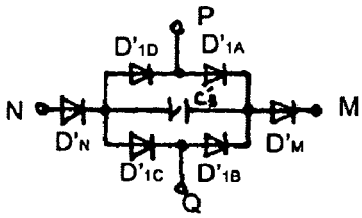
FIG. 3 is a circuit diagram of a full-wave rectifier power supply having a potential switch in accordance with the invention.

A full-wave rectifier power supply having potential switches is composed of rectifier diodes $D_{1A}'$, $D_{1B}'$, $D_{1C}'$, and $D_{1D}'$, potential switched diodes $D_M'$ and $D_N'$, and filter capacitor $C_3'$, as shown in FIG. 3, wherein $D_M'$ and $D_N'$ function as the potential switches to provide low voltage with large current.

IV. Illumination Controlled Illumination System Running In Serial

Figure 4:
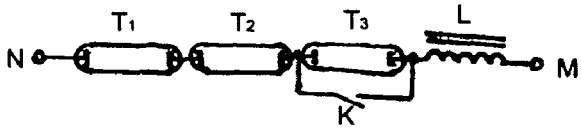
FIG. 4 is a circuit diagram of an illumination system operated in series with illumination controlled in accordance with the invention.

The tubes ($T_1$, $T_2$, $T_3$) connected in series are connected to a MN high voltage power supply via an inductor L with a switch K connected to the tube $T_3$ in parallel, and an illumination controlled illumination system is then formed, as shown in FIG. 4. Wherein L is used to increase the time constant of the load for adapting to the power supply, stabilizing the normal illumination and preventing the vibration (flashing).

Figure 5:
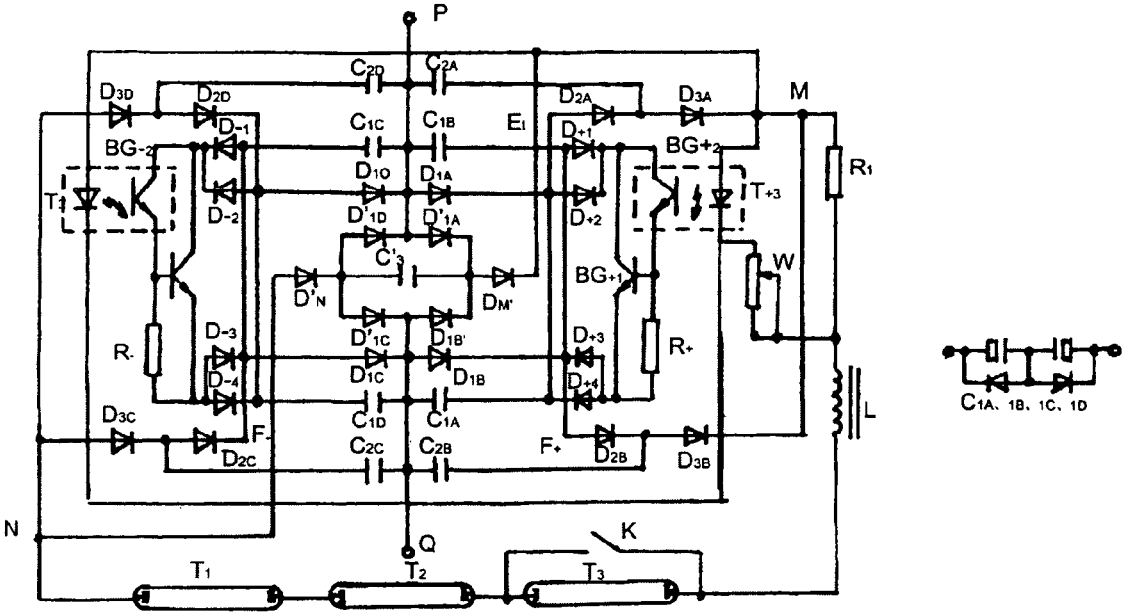
FIG. 5 is a circuit diagram of an illumination system which is illumination controlled by a photocoupler in accordance with the invention.

V. Illumination System Having Cold Cathode Started Gas Discharge Lamp With Illumination Controlled 1) A system with illumination control from photocoupler The circuit diagram of the whole illumination system is shown in FIG. 5. Wherein a resistor $R_1$ is connected in series in the main loop to shunt, a potentiometer W is connected in series with a light emitting diode of the photocoupler to control the illumination continuously, and the function of the switch K is to intermit the illumination control.

A main power supply is formed by combining the full-wave voltage-doubler power supply MN with the full-wave rectifier power supply via the potential switched diodes $D_M'$ and $D_N'$.

As shown in FIG. 5, the output current of the main loop can be detected by connecting a $R_1$ in the main loop for shunting and sampling, connecting the light emitting diodes $T_+$, $T_-$ of the two photocouplers in parallel, and then connecting the potentiometer W to the main loop to connect to $R_1$ in parallel.

The current amplifier tubes $BG_{+1}$, BG−1 are driven by the phototransistors $BG_{+2}$, $BG_{-2}$ of the photocoupler, respectively, to control the output current of the rectifier bridge $D_{+1}$, $D_{+2}$, $D_{+3}$, $D_{+4}$ and $D_{-1}$, $D_{-2}$, $D_{-3}$, $D_{-4}$, it has the control function of adjusting the output voltage of the full-wave voltage-doubler rectifier to control the output voltage $V_{MN}$.

When turning on the power supply, $V_{MN}$ outputs a high voltage, and the main current is zero. When $V_{MN}$ reaches the start voltage of the tubes $T_1$, $T_2$, and $T_3$, the tubes illuminate, the current of the main loop increases, the light emitting diodes of the photocoupler convert the main current into an optical signal which activates the optical current of the photoelectric transistors $BG_{+2}$, $BG_{-2}$ of the photocoupler circuit, and drives $BG_{+1}$, $BG_{-1}$ to make $V_{E+F+}$, $V_{E-F-}$ decrease, and causes $V_{MN}$ to decrease. Meanwhile, as the main current increases, the discharge amount of the voltage-doubler capacitors $C_{1ABCD}$, $C_{2ABCD}$ increases, and it further causes $V_{MN}$ to decrease, and they are combined together to form the internal resistance of the high voltage power supply, and the main current is controlled at a set current to achieve the result of a ballast. Adjusting W can change the sampling value of the main current, and thereby changing the control current can control the illumination of the lamp.

When $V_{MN} \leqq V_{C3}'$ (the output voltage of the full-wave rectifier), the power is supplied to the main loop by the municipal power source P, Q via the full-bridge $D_{1A}'$, $D_{1B}'$, $D_{1C}'$, $D_{1D}'$ and $D'_M$, $D_N'$, at this point, the photocoupler will no longer have the feedback function.

The conversion of two lamps and three lamps can be adjusted by the switch K to obtain weak illumination for three lamps and strong illumination for two lamps.

2) Illumination Controlled System Using Magnetic Saturation Reactor

Figure 6:
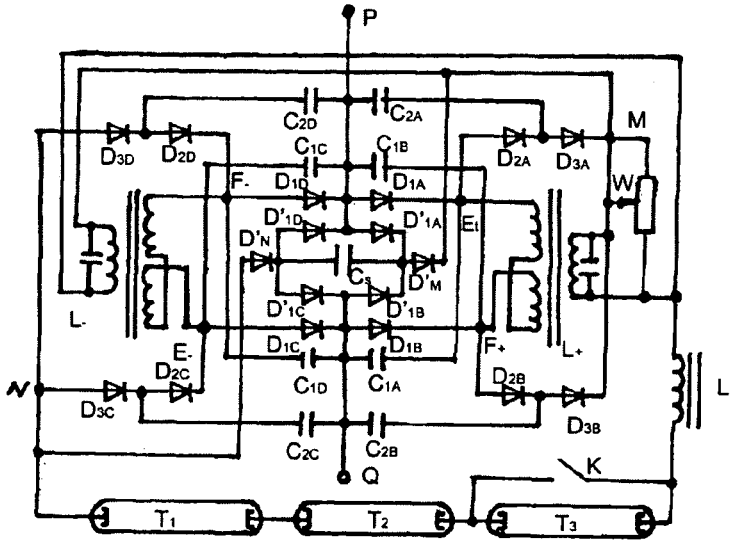
FIG. 6 is a circuit diagram of an illumination system which is illumination controlled by a magnetic saturation reactor in accordance with the invention.

As the circuit diagram shown in FIG. 6, the $L_+$ and $L_-$ are the magnetic saturation reactors, the potentiometer W is connected to the primary winding in parallel as a shunt for controlling the current in the main loop thereby the illumination of the illumination system can be controlled.

3) Illumination System With Illumination Controlled From Full-Wave Rectifier Filter Capacitor (Simplified as Capacitor-Illumination Controlled System)

Figure 9:
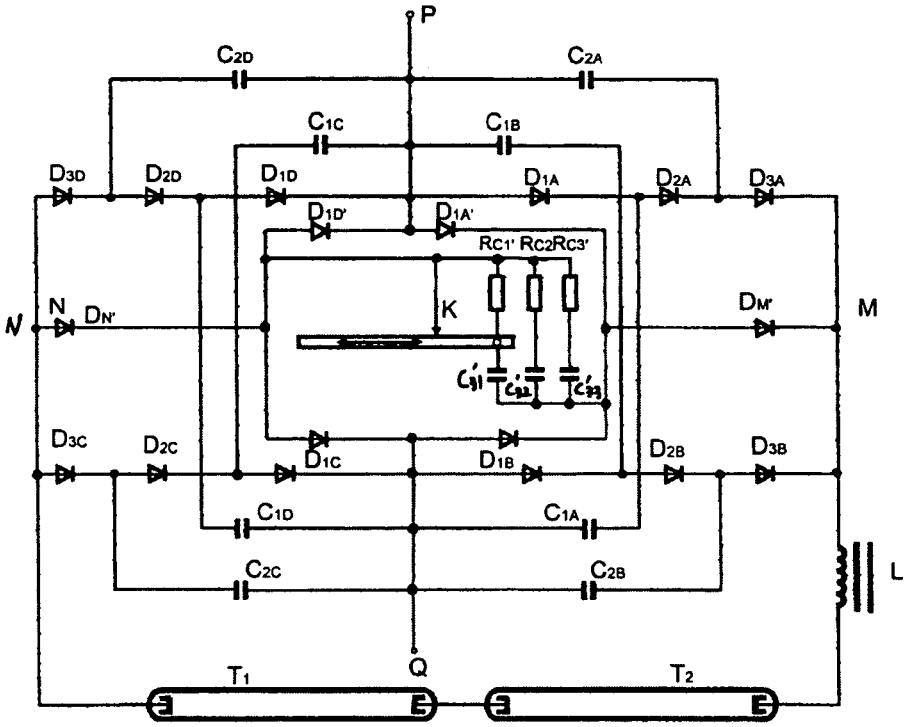
FIG. 9 is a circuit diagram of an illumination system which is illumination controlled by a full-wave rectification filter capacitor in accordance with the invention.

As the circuit diagram shown in FIG. 9, the output of the full-wave rectifier power supply can be adjusted by adjusting the capacitance of $C_3'$ (switching to the filter capacitors $C_{31}'$, $C_{32}'$, and $C_{33}'$ by a switch K') to obtain the function of illumination control. The resistors ($R_{C1}'$, $R_{C2}'$, and $R_{C3}'$) or the diodes connected with the capacitors in series function as a means for eliminating the spark in switching.

Figure 10:
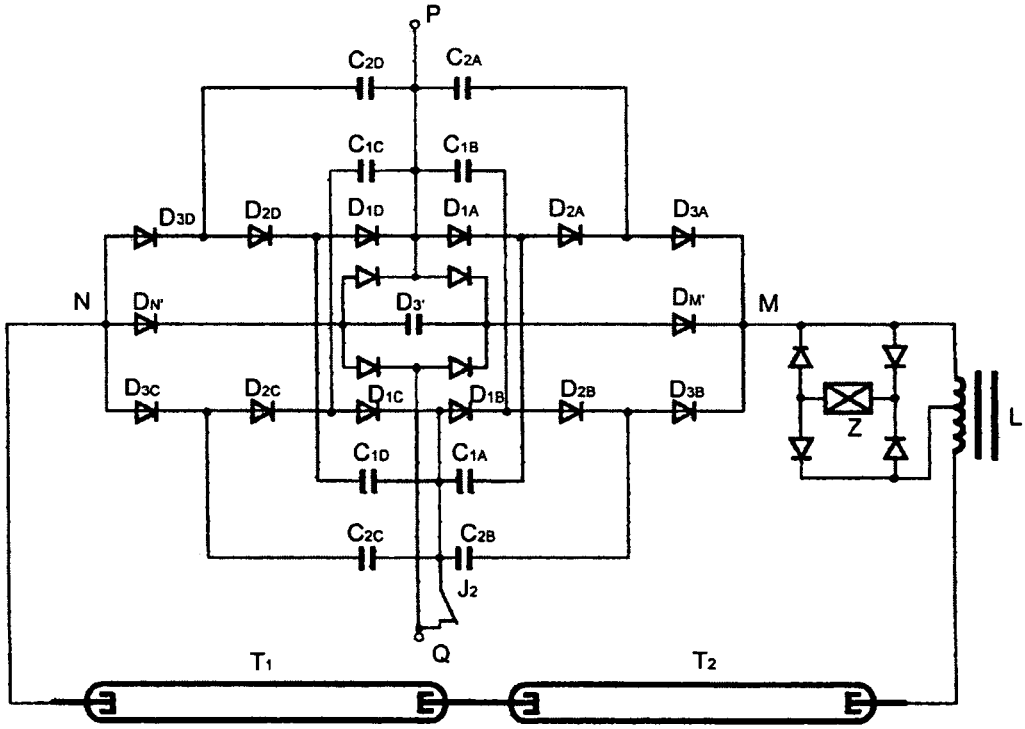
FIG. 10 is a circuit diagram of a simple illumination system without illumination control in accordance with the invention.

The power of the high voltage full-wave voltage-doubler rectifier power supply is controlled by a coil Z of a relay connected with the inductor L in series, after illuminating the gas discharge lamp, $J_2$ cuts off the power supply to improve the quality factor. The control coil Z of the relay is connected with the corresponding portion of the inductor L in parallel via the full-wave rectifier bridge of the diodes. Refer to FIG. 10.

The said control circuit can also be formed by a delay relay or a delay circuit, and the contacts of the relay can be formed by electronic switches (for example, bidirectional thyristors, it can be selected preferably based on the specific condition.

Figure 7:
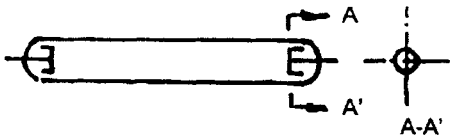
FIG. 7 is a structure diagram of a cold cathode fluorescent tube having single output lead and cover like electrode in accordance with the invention.

The cold cathode started fluorescent lamp does not require to heat the filament, and a structure with single output lead and cover like electrode is used for it in order to increase the area of the electrode and protect the electrode lead. The electronic emission material with low escape level can also be coated on the electrode, as show by FIG. 7.

Figure 8:
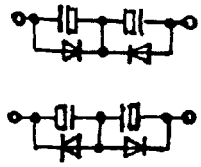
FIG. 8 is a circuit diagram of a non-polarity capacitor formed by tandem pairs of an electrolytic capacitor and a diode connected in parallel in accordance with the invention.

The aforesaid power supply requires a non-polarity capacitor having large capacitance, which can be formed by the tandem pairs of an electrolytic capacitor and a diode connected in parallel. The negative terminal of the diode is connected with the positive plate of the electrolytic capacitor, and the positive terminal of the diode is connected with the negative plate thereof. See FIG. 8.

Based on different tubes, different usage environments and different requirements, illumination controlled by switches, illumination controlled by full-wave rectifier filter capacitor (illumination controlled by capacitor for short), illumination controlled by photocoupler (illumination controlled by photo coupling for short), and illumination controlled by magnetic saturation reactor (illumination controlled by inductor for short) can be used, respectively. For the sake of popularization, a simplified illumination system without illumination control can be used as shown in FIG. 10.

Now the simplified illumination system without illumination control will be explained.

Turning on the power supply, $V_{MN}$ outputs a high voltage, and the main current is zero. When $V_{MN}$ reaches the start voltage of the tubes $T_1$ and $T_2$, the tubes illuminate, the current in the main loop increases, and $V_{MN}$ decreases.

When $V_{MN} \leqq V_{C3}'$, the municipal power source PQ supplies the power to the main loop via the full-wave rectifier and the potential switched diodes $D_M'$ and $D_N'$, the voltage $V_{C3}'$ of the full-wave rectifier filter decreases as the lamp current increases. It makes the main current to be stable at a set current, and causes the illumination system to illuminate. The lamp illuminates, the current increases, the relay Z closes, the normal closed contact $J_2$ opens, the power supply from the high voltage full-wave voltage-doubler power source is cut off, and the tube is illuminated directly by the municipal power via the full-wave rectifier bridge (or the voltage-doubler circuit) to improve the quality factor of the illumination system.

INDUSTRIAL APPLICABILITY

The advantages and the results of the invention are as follows.

1. Because the entire illumination system is composed of diodes, capacitors, and inductors, it is highly reliable and durable.

2. The work loss of the diodes and inductors under the direct current state is small and the capacitors have substantially no power dissipation, so it saves the electric energy.

3. Several tubes operate in series to share a power source, and thereby it decreases the cost and saves the electric energy.

4. The power source is not polluted. Since the power factor $\geqq 0.7$, it is capacitive to cause a leading current. This is an advantage to compensate the current lag of the municipal power and to decrease the dissipation of the power supplying lines.

5. The intensity of the light is adjusted by switches, capacitors, inductors, and potentiometers. It is easy to use, and it can increase the usage function and improve the quality factor.

6. There is no filament in the cold cathode start. It extends the life of the tube.

7. Since the neon startor is not used, the failure is reduced, and the restriction of the variation of the tube parameters can be relaxed. It makes the tubes which cannot be used in former can be used normally, and it reduces the consumption of the tubes (for example, the tubes, which have the broken filament, cannot be started, and flickers when operating, can be used normally with the series power supply).

8. The exhaustion of the carbon dioxide from the heat and power plant can be reduced, so it belongs to a "green" illumination. Thus, the life of the tube can be prolonged, and most of the wasted tubes can be used so that polluting the environment by the mercury in the wasted tubes can be reduced and the environment can be protected.

9. The diodes, inductors, and capacitors do not produce heat, and the voltage of the inductors operating in the direct current area is low, and thereby it prevents the insulation breakdown from occurring. Even if a capacitor is broken down, the power supply having overload protection can prevent short circuit and fire from occurring, thereby the security is excellent.

10. It can operate under the power supply of the alternating current of 200V and 110V with 50 Hz and 60 Hz.

What is claimed is:

1. An illumination system having cold cathode started, illumination controlled gas discharge lamps in series comprises:

AC input terminals (P, Q);

a DC positive output terminal (M) and a DC positive output terminal (N);

a full-wave voltage-doubler power supply circuit having a positive half-wave voltage-doubler power supply circuit ($D_{1A}$, $C_{1A}$, $D_{2A}$, $C_{2A}$, $D_{1C}$, $C_{1C}$, $D_{2C}$, $C_{2C}$) and a negative half-wave voltage-doubler power supply circuit ($D_{1B}$, $C_{1B}$, $D_{2B}$, $C_{2B}$, $D_{1D}$, $C_{1D}$, $D_{2D}$, $C_{2D}$) containing a plurality of voltage-doubler rectifier diodes and a plurality of voltage-doubler capacitors connected between the AC input terminals (P, Q), the DC positive output terminal (M) and the DC positive output terminal (N), wherein the positive half-wave voltage-doubler power supply circuit and the negative half-wave voltage-doubler power supply circuit are combined by a plurality of isolating diodes ($D_{3A}$, $D_{3B}$, $D_{3C}$, and $D_{3D}$) to form the full-wave voltage-doubler power supply circuit;

a full-wave rectifier power supply circuit having a full-wave bridge rectifier circuit ($D_{1A}'$, $D_{1B}'$, $D_{1C}'$, $D_{1D}'$) connected to the AC input terminals (P, Q); a filter capacitor ($C_3'$) connected between a positive voltage output terminal and a negative voltage output terminal; a positive potential switch diode ($D_M'$) having its anode connected to the positive voltage output terminal and its cathode connected to the DC positive output terminal (M); and a negative potential switch diode ($D_N'$) having its cathode connected to the negative voltage output terminal and its anode connected to the DC negative output terminal (N); and a plurality of gas discharge lamps and a serial inductor (L) connected in serial between the DC positive output terminal (M) and the DC negative output terminal (N);

wherein said voltage-doubler capacitors ($C_{1A}$, $C_{2A}$, $C_{1B}$, $C_{2B}$, $C_{1C}$, $C_{2C}$, $C_{1D}$, $C_{2D}$) are alternately charged and discharged, such that an AC commercial voltage source is transformed into a limited current source with internal resistance to be supplied to said gas discharge lamps.

2. The illumination system as claim 1, wherein said voltage-doubler capacitors are alternately charged and discharged to provide a continuous voltage-doubler output.

3. The illumination system as claim 2, wherein each gas discharge lamp is a cold cathode fluorescent lamp tube having single output lead and cover like electrode.

4. The illumination system as claim 2, wherein two ends of one or more lamps of said plurality of gas discharge lamps are connected to a switch (K) in parallel.

5. The illumination system as claim 1, wherein each gas discharge lamp is a cold cathode fluorescent lamp tube having single output lead and cover like electrode.

6. The illumination system as claim 1, wherein two ends of one or more lamps of said plurality of gas discharge lamps are connected to a switch (K) in parallel.

7. The illumination system as claim 1, wherein an alternating current path in the full-wave voltage-doubler power supply circuit is formed by connecting point ($E_+$, $F_+$, $E_-$, or $F_-$) of the voltage-doubler capacitors of a first stage and an access resistor or inductor or a bi-directional thyristor, or the full-wave rectifier current amplifier.

8. The illumination system as claim 1, wherein said voltage-doubler capacitors are charged by said AC commercial power and discharged to said gas discharge lamps via said isolating diodes ($D_{3A}$, $D_{3B}$, $D_{3C}$, $D_{3D}$), such that said AC commercial voltage source is transformed into said limited current source with internal resistance.

9. The illumination system as claim 1, wherein the filter capacitor ($C_3'$),further comprises of a the a plurality of rectifier capacitors ($C_{31}'$, $C_{32}'$, $C_{33}'$); a plurality of sparks-eliminating resistors ($R_{C1}'$, $R_{C2}'$, $R_{C3}'$); or diodes respectively connected in series with said plurality of rectifier capacitors; and a switch (K') for switching among said plurality of rectifier capacitors.

10. The illumination system as claim 1, wherein the full-wave voltage-doubler power supply circuit further comprises a non-polarity large capacitor composed of tandem pairs of an electrolytic capacitor and a diode connected in parallel.

11. The illumination system as claim 1, wherein said full-wave voltage-doubler power supply circuit consists of at least two stages of voltage-doubler power supply circuits, a second and succeeded stages of said voltage-doubler power supply circuits are controlled by a delay circuit or the lamp current passing through an AC switch, and the AC power supply from these circuits is cut off after the gas discharge lamp being lighting up, and then the power of the gas discharge lamp is supplied by said full-wave rectifier power supply circuit or a first stage of said voltage-doubler power supply circuit.

* * * * *